US005099996A

United States Patent [19]

Vallis

[11] Patent Number: 5,099,996

[45] Date of Patent: Mar. 31, 1992

[54] TRAY FOR CARTON HAVING FAN FOLDED PAPER THEREIN

[75] Inventor: Owen Vallis, Santa Clara, Calif.

[73] Assignee: Greg M. Shepherd, Palo Alto, Calif.

[21] Appl. No.: 529,699

[22] Filed: May 24, 1990

[51] Int. Cl.[5] ..... B65D 85/67

[52] U.S. Cl. ..... 206/449; 206/557; 220/521; 270/39; 271/3; 400/613.2

[58] Field of Search ..... 220/521

[56] References Cited

U.S. PATENT DOCUMENTS

| | | | |
|---|---|---|---|
| 1,423,845 | 7/1922 | Foss | 206/557 |
| 1,570,466 | 1/1926 | Essinger | 206/557 |
| 1,658,102 | 2/1928 | Snyder | 206/557 |
| 1,853,219 | 4/1932 | Newton | 206/45 |
| 1,974,552 | 9/1934 | Wallbank | 206/45 |
| 2,847,118 | 8/1985 | Johnson | 206/39.6 |
| 3,712,607 | 1/1979 | Ziegler et al. | 270/61 |
| 3,862,689 | 1/1975 | Taub | 206/45 |
| 4,406,448 | 9/1983 | Kulpa et al. | 271/167 |
| 4,530,689 | 7/1985 | Ringer, Sr. | 493/410 |
| 4,667,828 | 5/1987 | Samuelson | 206/555 |

FOREIGN PATENT DOCUMENTS

| | | | |
|---|---|---|---|
| 0555742 | 8/1929 | Fed. Rep. of Germany | 206/45 |
| 0111836 | 5/1987 | Japan | 271/145 |
| 0106918 | 8/1965 | Norway | 206/45 |
| 2148850 | 6/1985 | United Kingdom | 220/23.83 |

*Primary Examiner*—Jimmy G. Foster
*Attorney, Agent, or Firm*—Townsend and Townsend

[57] ABSTRACT

A tray for use with fan-folded paper fed to a printer or other paper processor at high speeds. The tray is adapted to be removably mounted on the open top of a paper carton to allow paper to be fed out of the carton along a predetermined path. The paper has a support plate which is adjacent to an opening defining the path of the paper out of the carton, and a support plate is positioned to allow the fan-folded paper to be returned in stacked relationship on the support plate without operator attention. The paper collected on the tray can be removed by hand at any time.

6 Claims, 2 Drawing Sheets

TRAY FOR CARTON HAVING FAN FOLDED PAPER THEREIN

This is a continuation of application Ser. No. 07/310,428, filed Feb. 13, 1989, now abandoned.

This invention relates to improvements in the feeding of fan-folded paper from a carton to a printer and, more particularly, to a tray for placement on the open top of a carton containing fan-folded paper for forming a feed path and for presenting a paper-receiving support.

BACKGROUND OF THE INVENTION

Paper feeding apparatus has been known and used in the past for feeding fan-folded paper into, through and out of a printer for high-speed printing of the paper. Generally, such apparatus has been complex in construction and requires a considerable amount of space. Typical of this type of apparatus are the structures shown in U.S. Pat. No. 3,712,607 to Ziegler and U.S. Pat. No. 4,530,689 to Ringer.

Ziegler shows a paper feeding assembly in which a table 3 (FIG. 1) has a lower shelf 18 for receiving and supporting a supply of paper. The paper is fed from the supply upwardly along the dashed lines shown in FIG. 1, around a printer 21, then up and over a series of rods 5 through a passage defined by numeral 8 and then onto a guide lever 11 which is pivotal on the support and is the support for the processed paper in a fan-folded condition.

Ringer shows several embodiments of a paper supporting and feeding assembly. In the first embodiment shown in FIGS. 1–6, the paper is supported on upper shelf 12 and is collected on a lower shelf 14. FIG. 2 shows the path of the paper from the stack of paper on the upper shelf 12, the paper feeding over an upper curved edge 18 then downwardly and beneath a second curved edge 14 and then to a printer 24, out of the printer and into fan-folded condition on lower shelf 14.

FIG. 6 of Ringer shows another view of the way in which paper is fed from the upper shelf, through the printer and into a lower shelf.

FIG. 7–11 show another embodiment in Ringer of the assembly which comprise a number of shelves 12, 14 and 42 (FIG. 7). Paper is fed from a box 31 on the upper shelf 12, over the upper edge 18, then downwardly beneath the lower edge and into a printer 24 and then back into a fan-folded condition on a shelf therebelow.

In view of the complexity of paper handling devices on up until the present time, a need exists for improvements in paper handling devices which are simple and rugged in construction and inexpensive to produce and maintain as well as to simplify the structure such that any unskilled person can use the device. The present invention satisfies this need.

SUMMARY OF THE INVENTION

The present invention is directed to a tray for use with fan-folded paper fed to a printer or other paper processor at high speeds. The tray is adapted to be removably mounted on the open top of a paper carton and to allow fan-folded paper to be fed out of the carton along a predetermined path to and through a printer or paper processor. The tray has a support plate which is adjacent to an opening defining the path of the paper out of the carton, and the support plate is positioned to allow the fan-folded paper to be returned in stacked relationship on the support plate without operator attention. The paper collected on the support plate can be removed by hand at any time.

The primary object of this invention is to provide an improved tray for use with a carton containing fan-folded paper wherein the tray has an opening which forms part of the path of the paper moving from the carton to a printer and the tray is adapted to receive the paper in a stack after it has passed through the printer to simplify the handling of the paper without requiring special skills to use the tray with the carton.

Another object of the present invention is to provide a tray of the type described, wherein the tray is simple and rugged in construction, is inexpensive to produce and has no moving parts to thereby permit the tray to be quickly and easily put into place for use and stored when not in use.

Other objects of this invention will become apparent as the following specification progresses, reference being made to the accompanying drawings for an illustration of a preferred embodiment of the invention.

DETAILED DESCRIPTION OF THE DRAWINGS

Figure 2:
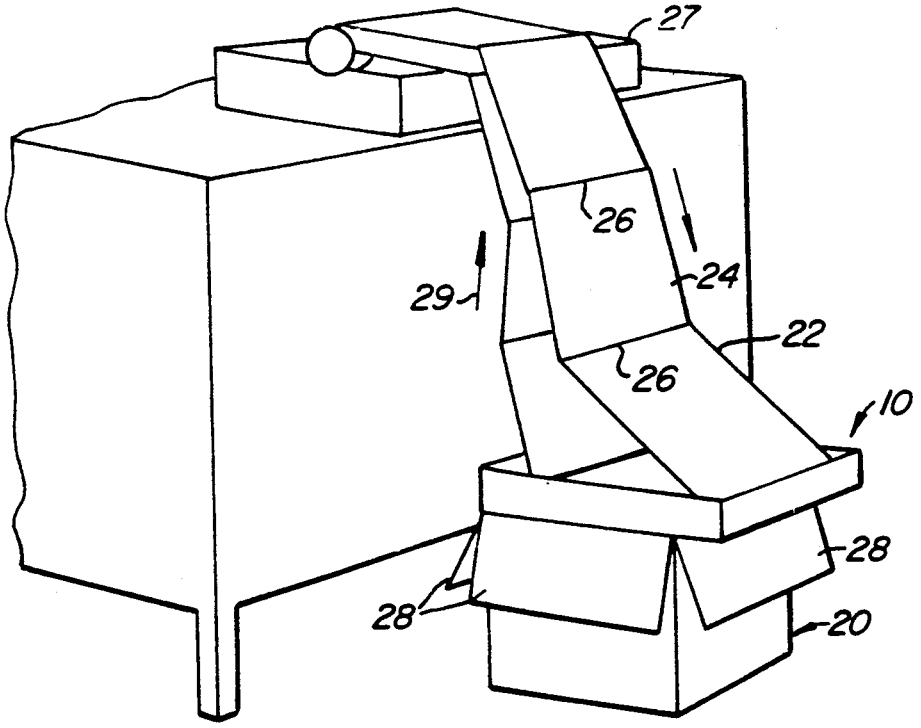
FIG. 2 is a fragmentary, perspective view of a printing system using the tray of FIG. 1 with a carton or box containing a supply of continuous fee, perforated paper fed to and from a printer.
Figure 3:
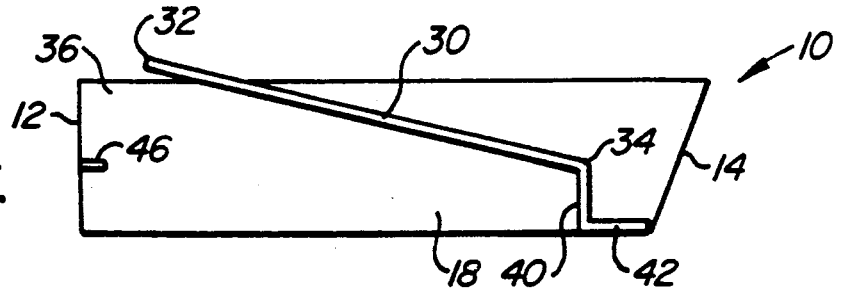
FIG. 3 is a side elevational view of the tray of FIG. 1.
Figure 4:
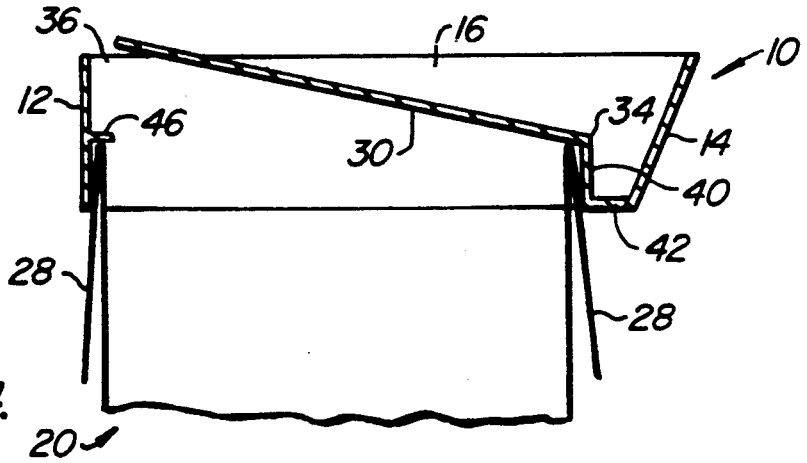
FIG. 4 is a vertical section through the tray, showing the way in which it is mounted on a box containing paper to be fed to the printer.

The tray of the present invention is broadly denoted by the numeral 10 and includes a pair of spaced end walls 12 and 14 and a pair of spaced, parallel side walls 16 and 18, wall 14 being inclined (FIGS. 3 and 4). The side and end walls are coupled together at adjacent marginal edges to present a rectangular configuration which is substantially complemental to the upper open end of a carton 20 (FIG. 2) containing a supply of continuous feed, perforated, fan-folded paper in the form of a stream 22 of paper, the stream being comprised of individual paper sheets 24 coupled together at perforated lines of weaknesses 26. The paper is conventional in construction, and carton 20 is also of a standard size and shape. The carton has flaps 28 for closing the open top thereof, the flaps being foldable into the open positions thereof shown in FIG. 2 when tray 10 is to be used with the carton to feed the paper from the carton.

Tray 10 includes an inclined support plate 30 which extends between and is secured to the inner surfaces of side walls 16 and 18. The plate has a front marginal edge 32 and a rear marginal edge 34, edge 32 being above the upper marginal edges of sides 16 and 18 as shown in FIGS. 3 and 4.

Figure 1:
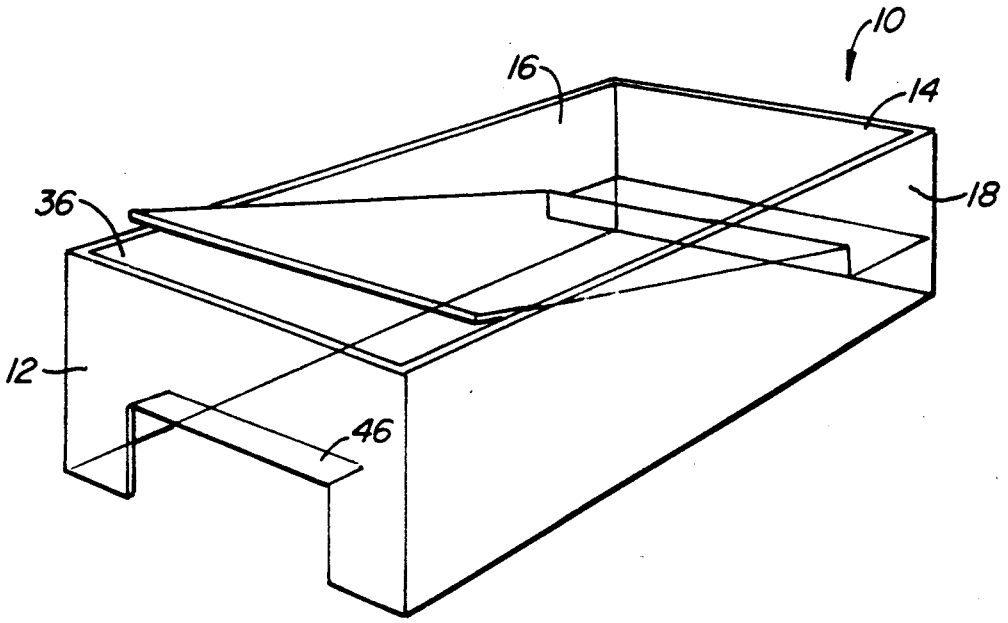
FIG. 1 is a perspective view of the paper tray of the present invention.

Front marginal edge 32 of support plate 30 forms an opening 36 with end wall 12 as shown in FIGS. 1, 3 and 4. Opening 36 is provided to allow paper to be moved out of carton 20, through the opening and toward printer 27 in the direction of arrow 29 (FIG. 2). The width of the opening 36, i.e., the dimension between side walls 16 and 18, is substantially the same or slightly greater than the width of the paper sheets 24. Thus, the paper position is maintained properly and fed correctly with respect to printer 27 when the printer is in operation and as the paper is moved out of the carton in the direction of arrow 29 (FIG. 2).

A wall segment 40 (FIG. 3) is coupled with the rear marginal edge 34 of support plate 30 and extends downwardly therefrom. Wall segment 40 is adapted to overlap the adjacent flap 28 of carton 20 to hold the flap in its open position in the manner shown in FIG. 4. A second wall segment 42 secured to the lower marginal edge of segment 40 extends rearwardly to end wall 14 and is secured to the end wall.

Figure 5:
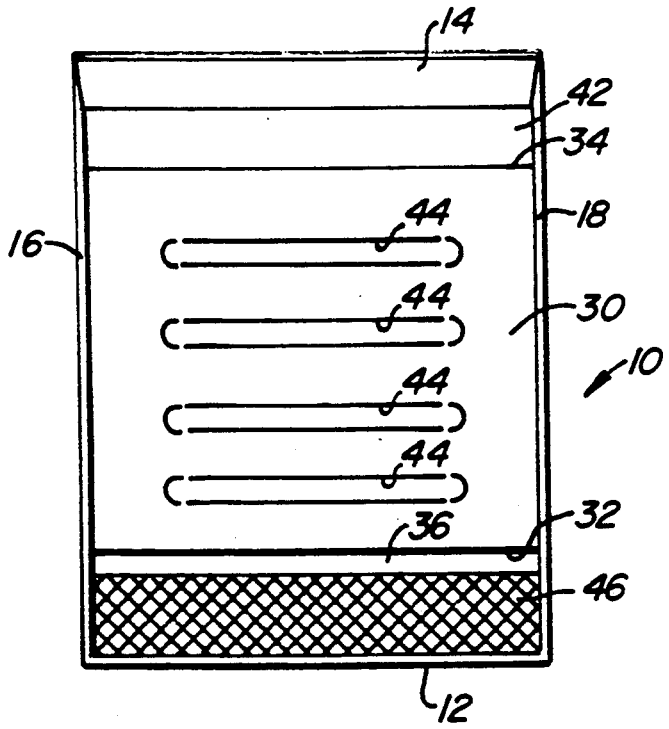
FIG. 5 is a top plan view of the tray.

Support plate 30 may be provided with elongated ribs which are parallel with each other as shown in FIG. 5. The purpose of the ribs is to facilitate the removal of paper when the sheet stack is supported by support plate 30.

End wall 12 has a ledge or shoulder 46 as shown in FIGS. 1, 3 and 5. This ledge or shoulder is adapted to rest on the upper marginal edge of carton 20 when adjacent flap 28 is bent downwardly in the manner shown in FIG. 4. Thus, the tray 10, when placed on carton 20 is supported at the rear marginal edge portion of support plate 30 and at the front on ledge 46.

In use, tray 10 is placed on a carton 20 containing fan-folded paper sheets 24 with the carton being placed adjacent to and below printer 27 when mounted on a table or other surface. When tray 10 is removably mounted on carton 20, flaps 28 of the carton will be open and will extend downwardly along the adjacent sides and ends of the carton 20 as shown in FIG. 2. The tray will be resting on the upper marginal end edge of the carton as shown in FIG. 4, namely with ledge 46 engaging one marginal end edge of the carton and the lower end surface of support plate 30 resting on the other upper marginal end edge of the carton. The lower portions of end wall 12 (FIG. 1) extend downwardly a short distance past the adjacent upper edge of the carton to keep the flap adjacent thereto tucked in and held against the end wall of the carton. Similarly, segment 40 (FIG. 4) extends downwardly from the upper marginal edge of the carton and keeps the adjacent flap 28 tucked against the adjacent end wall of the carton. Initially, the carton flaps 28 will not interfere with the movement of the paper out of the carton and into a fan-folding condition on support plate 30.

The paper is first manually pulled out of the carton through opening 36 of the tray 30 and upwardly around the platen of printer 27, whereupon the paper is fed manually down so that the lead paper sheet 24 rests on support plate 30. Then, the printer is actuated to automatically cause the paper to be fed through the printer and out of the carton. As the paper comes out of the printer, it fan-folds automatically into a neat stack on support plate 30. The leading edge of each paper sheet 24 will engage the inner surface of end wall 14 so as to make end wall 14 a stop for the stack of paper sheet 24. As soon as the printing has been completed, the paper stack on support plate 30 of tray 10 is manually removed by lifting it from the support plate and the tray is ready once again to receive a second stack of sheets 24 when the printer is next actuated.

Tray 10 can be made of any suitable material, such as metal, wood or plastic. Preferably it is formed of plastic material to render it light in weight and inexpensive to produce. Since the tray has no moving parts, it is essentially maintenance-free and can be used without any special skills on the part of the user. The tray can be quickly and easily removed from a carton and stored until ready for later use.

I claim:

1. Apparatus for handling paper comprising:

an open top carton for containing a stack of fanfolded paper, said carton having top flaps movable into open positions; and a tray supported on said upper marginal edge portion of the carton, said tray having spaced surface portions engaging the flaps on the cartons to hold the flaps in their open positions when the tray is supported on the carton, said tray having a slot for forming part of a path for the paper out of the carton to permit the paper to pass through a paper processor, said tray having receiving means for receiving a stack of fan-folded paper after the paper has emerged from the paper processor.

2. Apparatus as set forth in claim 1, wherein said receiving means includes an inclined support plate and an end wall near the lower end of the support plate, said support plate adapted to receive and support fan-folded paper as the paper emerges from a paper processor as the end wall forms a stop for the paper.

3. Apparatus for handling paper from an open top carton containing a stack of fan-folded paper comprising:

a tray for engaging the upper marginal edge portion of the carton, said tray having a pair of generally parallel side walls and a pair of end walls, said tray including an inclined support plate for receiving a stack of fan-folded paper after the paper has emerged from the paper processor, said support plate spanning the distance between the side walls and extending between the end walls, said support plate having an end spaced from an upper margin of one of the end walls top resent a slot through which the paper passes as it moves from the carton to the paper processor, said support plate having a second end spaced from the adjacent end wall, said second end being engageable with the carton.

4. Apparatus for handling paper from an open top carton containing a stack of fan-folded paper comprising:

a tray for engaging the upper marginal edge portion of the carton, said tray having a pair of generally parallel side walls and a pair of end walls, said tray including a support plate for receiving a stack of fan-folded paper after the paper has emerged from the paper processor, said support plate spanning the distance between the side walls and extending between the end walls, said support plate having an end edge spaced from an upper marginal edge of one of the end walls to present a slot through which the paper passes as it moves from the carton to the paper processor, said tray having support means including a first ledge on said one of the end walls and a shoulder near the opposite one of the end walls for supporting the tray on the carton.

5. Apparatus for handling paper from an open top carton having an upper marginal edge portion and containing a stack of fan-folded paper comprising:

a tray having support means for engaging the upper marginal edge portion of the carton to support the tray thereon, said tray having a slot for forming part of a path for the paper as the paper moves out of the carton to permit the paper to pass toward a paper processor, said tray having an inclined support plate for supporting the fan-folded paper after it has passed through the paper processor, said tray having an end wall, the support plate and the end wall having respective, spaced apart edges to present said slot, said support plate being in a position to receive and support a stack of fan-folded paper after the paper has emerged from the paper processor, and stop means adjacent to the support plate for providing a stop to retain the stack of paper on the support plate.

6. Apparatus as set forth in claim 5, wherein said stop means includes a second end wall near the lower end of the support plate, said support plate adapted to receive and support fan-folded paper as the paper emerges from a paper processor as the second end wall forms a stop for the paper.

* * * * *